US005775481A

United States Patent [19]

Lyke

[11] Patent Number: 5,775,481

[45] Date of Patent: Jul. 7, 1998

[54] LOCKOFF DEVICE AND METHOD FOR POSITIVELY INDICATING THE STATE OF A DISTRIBUTION DEVICE

[75] Inventor: Andrew John Lyke, Iowa City, Iowa

[73] Assignee: Square D Company, Palatine, Ill.

[21] Appl. No.: 774,803

[22] Filed: Dec. 31, 1996

[51] Int. Cl.[6] ..... H01H 9/28

[52] U.S. Cl. ..... 200/43.22; 200/43.01; 200/43.14

[58] Field of Search ..... 200/43.22, 333, 200/334, 43.14, 43.11, 43.01

[56] References Cited

U.S. PATENT DOCUMENTS

| | | | |
|---|---|---|---|
| 3,096,409 | 7/1963 | Hubbel et al. | 200/43.22 |
| 3,204,807 | 9/1965 | Ramsing | 200/333 |
| 4,638,129 | 1/1987 | Partus et al. | 200/43.22 |
| 4,978,816 | 12/1990 | Castonguay et al. | 200/43.22 |

*Primary Examiner*—David J. Walczak
*Attorney, Agent, or Firm*—Larry I. Golden; Kareem M. Irfan

[57] ABSTRACT

A guard for preventing movement of a handle by an operator from a locked position to a second position. The handle is coupled to an operating mechanism which controls a distribution device. The handle extends outwardly from the surface of the distribution device. The guard includes a cover which is configured to substantially enclose the handle while in the locked position. The cover is supported about the handle by abutting the surface of the distribution device. The cover is also configured to allow the handle to move from the locked position to the second position wherein the cover prevents an operator, but not the operating mechanism, from moving the handle from the locked position to the second position and the handle positively indicates the state of the operating mechanism between the positions. The guard also locks the cover to the distribution device. The present invention also a method of positively indicating the state of an operating mechanism controlling a distribution device while simultaneously preventing movement of a handle coupled to the operating mechanism by an operator from a locked position to a second position. The handle is coupled to an operating mechanism which controls a distribution device. The handle extends outwardly from the surface of the distribution device.

17 Claims, 2 Drawing Sheets

LOCKOFF DEVICE AND METHOD FOR POSITIVELY INDICATING THE STATE OF A DISTRIBUTION DEVICE

FIELD OF THE INVENTION

The present invention relates to a safety lockoff device and guard for a handle coupled to an operating mechanism which controls a distribution device wherein the safety lockoff prevents an operator, but not the operating mechanism, from moving the handle while in a locked position. More particularly, the safety lockoff allows the handle to positively indicate the state of electrical contacts in circuit interrupters, switches, and the like.

BACKGROUND OF THE INVENTION

Distribution devices often use an operating mechanism coupled to an external operating means such as a handle and a member controlling the item itself being distributed. For example, electrical switches, circuit breakers, and other circuit interrupters distribute power for commercial and industrial applications using an operating mechanism to couple an external handle to electrical contacts. Similarly, process controls distribute fluids or materials using an operating mechanism to couple an external handle to valves by a spring, pneumatic coupling or other compliant means.

In many instances, it is desirable and may even be required by government regulation or industry standards to lock the distribution device, often referred to as "lockoff", to prevent unauthorized operation and /or for safety considerations. A conventional method to provide lockoff is to use a bar or other member with a simple locking mechanism to prevent the handle of the distribution device from moving by the application of force external to the device.

The result of physically restricting the movement of the handle is that the operating mechanism of the device is also prohibited from moving the handle to another position with the application of internal force. One of the problems caused by this method of lockoff is that the handle may not accurately reflect the state of the operating mechanism and/or controlling member. An operator may be mislead as to the condition of the operating mechanism and rely on the false indication provided by the handle to place the operator in a dangerous situation.

There is a need to provide for the lockoff of a distribution device without physically restricting the movement of the handle to the internal force generated by the device's operating mechanism and/or controlling member. As a result, the handle will always provide a positive indication of the state of the operating mechanism and/or controlling member.

SUMMARY OF THE INVENTION

The present invention provides a guard for preventing movement of a handle by an operator from a locked position to a second position. The handle is coupled to an operating mechanism which controls a distribution device. The handle extends outwardly from the surface of the distribution device. The guard includes a cover which is configured to substantially enclose the handle while in the locked position. The cover is supported about the handle by abutting the surface of the distribution device. The cover is also configured to allow the handle to move from the locked position to the second position wherein the cover prevents an operator, but not the operating mechanism, from moving the handle from the locked position to the second position and the handle positively indicates the state of the operating mechanism between the positions. The guard also includes means for reversibly locking the cover to the distribution device. The locking means is integrally formed with the cover.

In another embodiment, the present invention provides a guard for preventing movement of a handle by an operator from an OPEN position to a CLOSED position. The handle is coupled to an operating mechanism which controls the electrical contacts of a circuit interrupter. The handle extends outwardly from a mating surface of the circuit interrupter. The guard includes a cover which is configured to substantially enclose the handle while in the locked position. The cover has a complimentary shape for abutting the mating surface of the circuit interrupter for support of the cover near the handle. The cover is also configured to allow the handle to move from the OPEN position to the CLOSED position wherein the cover prevents an operator, but not the operating mechanism, from moving the handle from the OPEN position to the CLOSED position and the handle positively indicates the state of the electrical contacts between the positions. The guard also includes means for reversibly fastening the cover to the circuit interrupter.

The present invention also contemplates a method of positively indicating the state of an operating mechanism controlling a distribution device while simultaneously preventing movement of a handle coupled to the operating mechanism by an operator from a locked position to a second position. The handle is coupled to an operating mechanism which controls a distribution device. The handle extends outwardly from the surface of the distribution device. The method includes the steps of: enclosing the handle with a cover to prevent the operator access to the handle while in the locked position; supporting the cover about the handle by abutting cover to the surface of the distribution device; reversibly locking the cover to the distribution device; and allowing the operating mechanism to move the handle from the locked position to a second position without interference from the cover wherein the handle positively indicates the state of the operating mechanism between the positions.

An object of the present invention is to provide a lockoff for a distribution device which does not physically restrict the movement of a handle to the internal force generated by the device's operating mechanism and /or controlling member.

Another object of the invention is to provide a lockoff device which allows a handle to always provide a positive indication of the state of the operating mechanism and/or controlling member.

Other and further advantages, embodiments, variations and the like will be apparent to those skilled-in-the-art from the present specification taken with the accompanying drawings and appended claims.

BRIEF DESCRIPTION OF THE DRAWINGS

In the drawings, which comprise a portion of this disclosure.

DESCRIPTION OF THE PREFERRED EMBODIMENT

Figure 1:
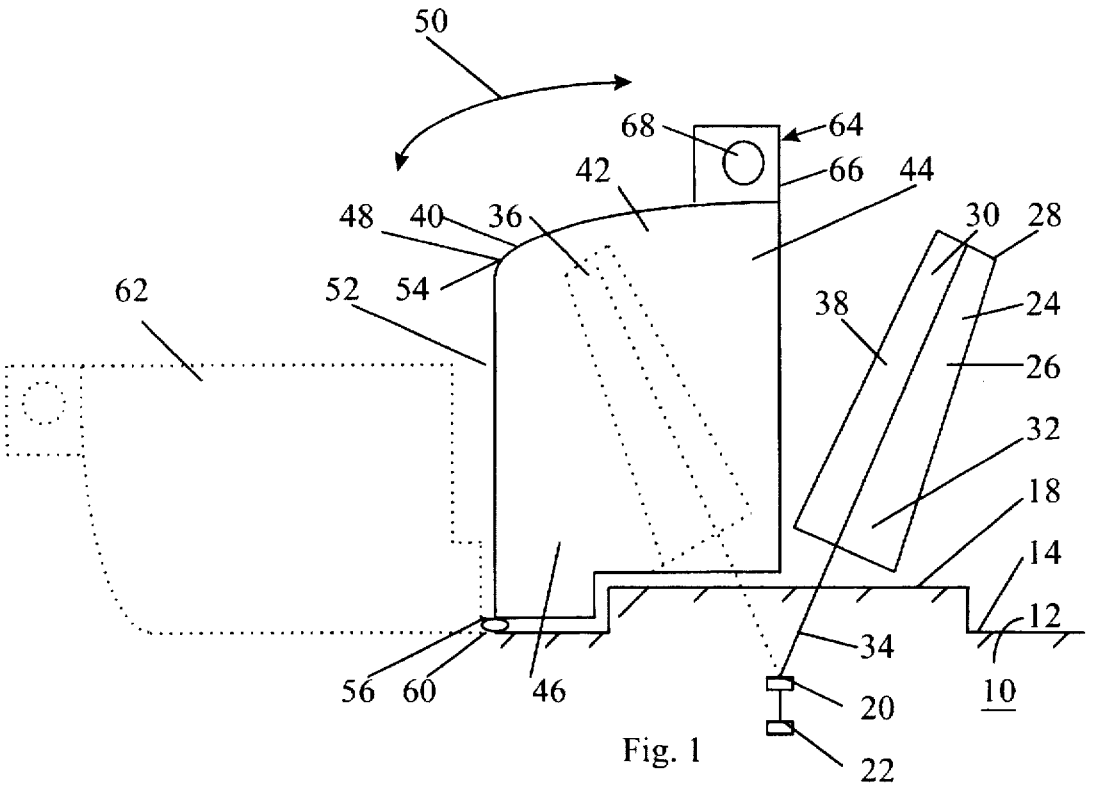
FIG. 1 is a partial side view of a cover panel for a circuit interrupter with a guard of the present invention in a first position for lockoff and with the same guard shown in a second position being unlocked, the handle demonstrating freedom of movement between the OPEN and CLOSED positions with the guard in a locked position.

Referring now to FIG. 1, a circuit interrupter for an electric circuit is generally indicated by the reference numeral 10. The circuit interrupter 10 includes an enclosure 12 defined by a cover panel 14 which connects to walls (not shown) of the enclosure 12 to provide an interior cavity generally designated as 16. The cover panel 14 has an exterior surface 18. As defined herein, the term circuit interrupter specifically includes, but is not limited to, circuit breakers, switches, and the like.

The circuit interrupter 10 includes an operating mechanism 20 connected to electrical contacts 22 within the interior cavity 16. The electrical contacts 22 are CLOSED to complete the electrical circuit and OPEN to disconnect or open the circuit. The circuit interrupter 10 also includes a handle 24 externally accessible to an operator. The handle extends outwardly from the surface 18 of the enclosure.

The handle 24 preferably includes a body 26 having an elongated shape with one end 28 forming a hand-grip 30. Other means adapted to be manually controlled by an operator are also suitable for use by the invention. The opposite end 32 of the first piece provides a connecting rod 34 or other means for fixedly securing to and operating the switch mechanism 20 by converting the translational movement of the hand-grip 30 into a rotational movement. When the handle 24 is in the OPEN position as indicated by reference numeral 36 the electrical contacts and circuit are open. When the handle 24 is in the CLOSED position 38 the electrical contacts are closed and the circuit is complete or ON.

A lockoff device 40 is provided by the present invention and includes a guard 42 for preventing movement of the handle 24 from the OPEN position 36 to the CLOSED position 38. The guard 42 has a cover 44 configured to substantially enclose the handle 24 while it is in the OPEN position 36. The cover 44 includes a base 46 having a perimeter 48. Preferably, the base 46 is elongated parallel to the direction of movement, as indicated by arrow 50, of the handle 24 between the OPEN position 36 and the CLOSED position 38.

A wall 52, having one end 54 integrally formed with the perimeter 48, extends substantially continuously about the perimeter 48 of the base. The wall 52 upstands generally perpendicular from the base 46. The opposite end 56 of the wall is configured to abut the surface 18 of the enclosure. In this embodiment of the present invention, the cover 44 can be made of a material which is either opaque or transparent.

The cover 44 includes an opening 58 in the wall 52. The opening 58 is positioned in the cover perpendicular to the direction of movement 50 of the handle. The opening 58 is configured to allow the handle 24 to externally pass from being enclosed underneath the cover 44 as the handle 24 moves between the OPEN position 36 and the CLOSED position 38. The opening 58 specifically allows the handle 24 to travel across the full range of movement between the OPEN and CLOSED positions 36, 38 without interference from the cover 44. Thus, the operating mechanism 20 is not restrained from providing the force to urge the handle 24 from one position to another.

Optionally, the cover 44 can include a hinge 60 located at one end of the cover. The hinge 60 is configured to engage the surface 18 of the enclosure near the handle 24 so that the guard 42 reversibly swings away from the locked position 61 on the surface 18 to an unlocked position indicated by reference numeral 62 using the hinge 60. While in the unlocked position 62, the operator can access the handle 24 while the handle is in the OPEN position 36.

Figure 2:
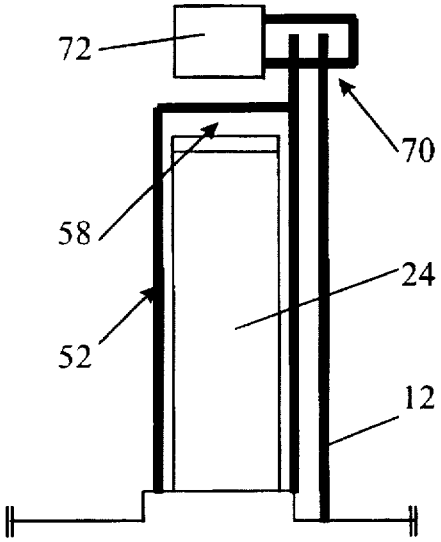
FIG. 2 is a partial end view of the circuit interrupter of FIG. 1 with the guard in the first position for lockoff.

The lockoff device 40 includes a lock, generally designated as 64, configured to reversibly secure the guard 42 to the enclosure 12. Preferably, the lock 64 is a hasp 66 which includes a first element or aperture 68 integrally formed with the cover 44. The enclosure 12 includes a corresponding second aperture 70 which extends upwardly from the surface 18 to mate with the first aperture 68 as seen in FIG. 2. A padlock 72 extends through the first and second apertures 68, 70 to secure the guard 42 to the surface 18 of the enclosure. The hasp 66 can use other elements as part of the fastener such as a slot to fit over another type of staple and be secured by a pin or bolt.

Figure 3:
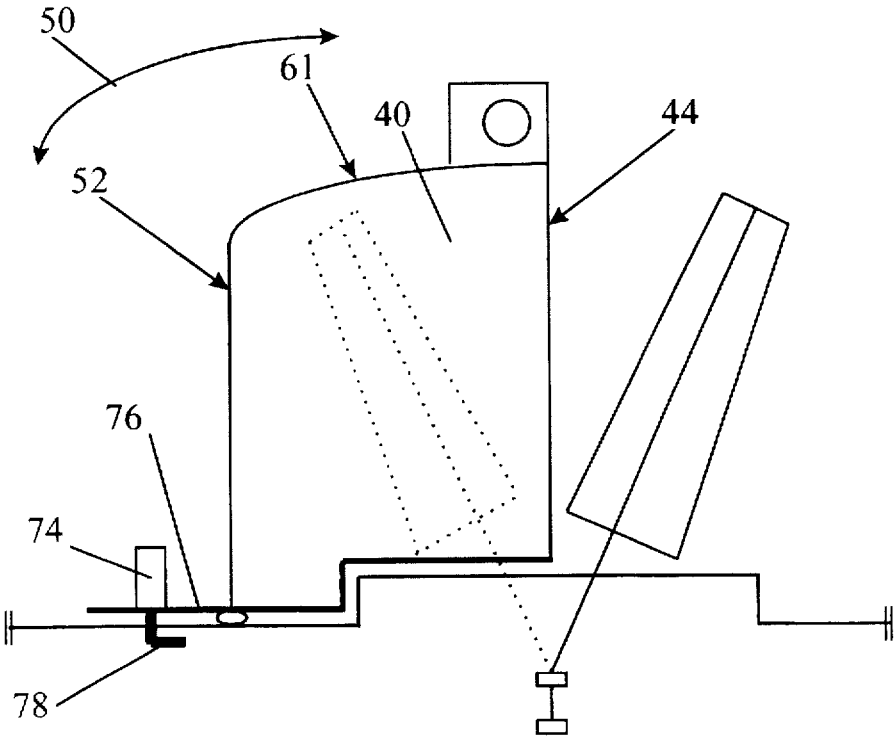
FIG. 3 is a partial side view of the guard illustrated in FIG. 1 with a cylindrical lock for reversibly securing the guard to the circuit interrupter.

FIG. 3 illustrates another means for reversibly locking the cover 44 to the circuit interrupter 10. The lock 64 includes a keyed cylinder 74 which connects to a flange 76 extending from one end of the cover 44. The cylinder 74 includes a latch 78 controlled by a key (not shown) which rotates to engage the underside of the surface 18 of the enclosure to secure the cover 44 to the enclosure 12.

Figure 5:
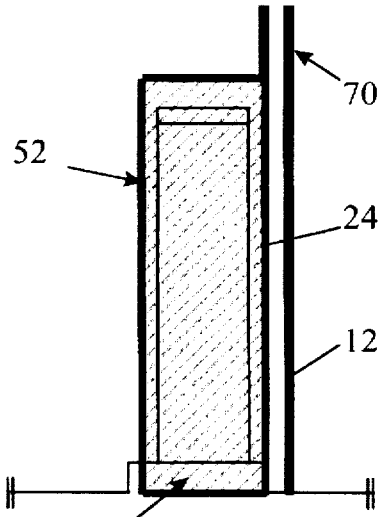
FIG. 5 is a partial end view of the circuit interrupter of FIG. 4 with the transparent guard in the first position for lockoff.
Figure 4:
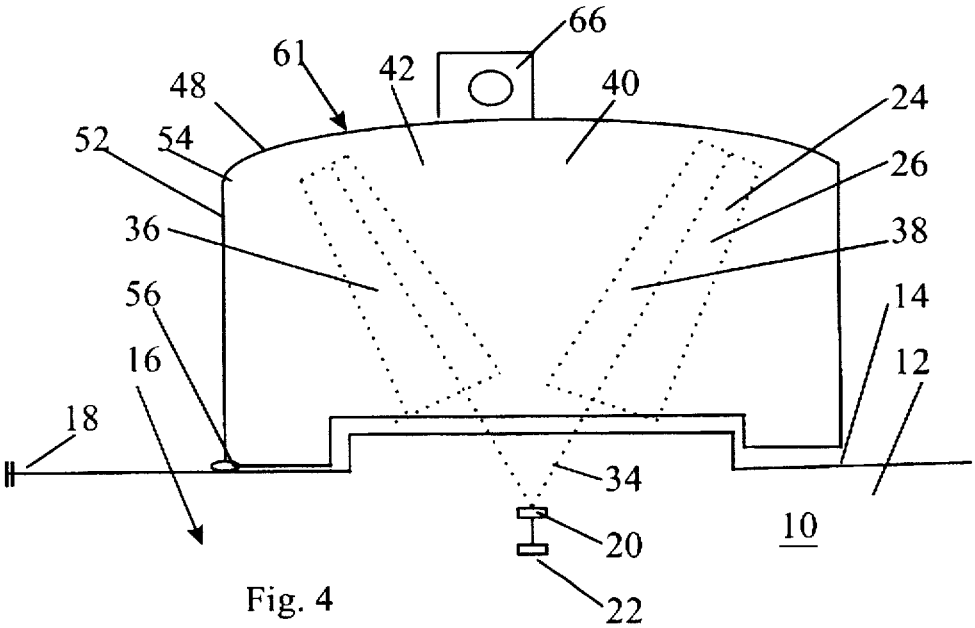
FIG. 4 is a partial side view of an alternate embodiment of the present invention with a circuit interrupter connected to a transparent guard in a first position for lockoff and a handle demonstrating freedom of movement between the OPEN and CLOSED positions with the present invention in place.

Another embodiment of the present invention is illustrated in FIGS. 4 and 5. The same reference numerals used in FIGS. 1 and 2 will be used to describe the similar elements. A guard 80 has a cover 84 configured to substantially enclose the handle 24 while it is in the OPEN position 36 and in the CLOSED position 38. The cover 84 includes a base 46 having a perimeter 48. Preferably, the base 46 is elongated parallel to the direction of movement, as indicated by arrow 50, of the handle 24 between the OPEN position 36 and the CLOSED position 38.

A wall 52, having one end 54 integrally formed with the perimeter 48, extends substantially continuously about the perimeter 48 of the base. The wall 52 upstands generally perpendicular from the base 46. The opposite end 56 of the wall is configured to abut the surface 18 of the enclosure. The cover 84 specifically does not include an opening to allow passage of the handle 24 external to the cover 84. Nonetheless, the cover 84 specifically allows the handle 24 to travel across the full range of movement between the OPEN and CLOSED positions 36, 38 without interference from the cover 84. Thus, the operating mechanism 20 is not restrained from providing the force to urge the handle 24 from one position to another.

In this embodiment of the present invention, the cover 84 allows the handle 24 to be viewed by the operator through the cover 84 itself. This can be accomplished by making the cover 84, either wholly or partially of a material which is transparent. Other means of allowing the handle 24 to be visible are suitable. For example and not to be limiting, a window or narrow aperture can be provided in the cover 84. However, if an aperture is used it should not be so configured or sized as to provide access to the handle 24 by the operator if the guard is in the locked position 61.

Although the present invention has been specifically illustrated for use with a circuit interrupter, it is not limited to electrical distribution devices and can be used on any type of distribution device. The operating mechanism can be coupled to any type of member for controlling the distribution of materials including solids, liquids or gases. For example, process fluid valves and other controls often couple the operating means or handle to the controlled member by a spring, pneumatic coupling, or other compliant means.

The OPEN position described above can be any desired "locked" position for a distribution device. The CLOSED position can be any second position that the handle and operating mechanism moves from after the locked or first position.

The present invention prevents the operator from moving a handle from its locked position to provide the safety of a conventional lockoff device, but will not hold the handle in the locked position if the operating mechanism would have moved it to another or second position. Thus, the lockoff device will not retain the handle in the OPEN position, for example in a circuit breaker, when the operating mechanism has urged the handle to the CLOSED position because the electrical contacts have closed, creating a hazardous condition.

The present invention also provides a method of positively indicating the state of an operating mechanism controlling a distribution device while simultaneously preventing movement of a handle coupled to the operating mechanism by an operator from a locked position to a second position. The handle is coupled to an operating mechanism which controls a distribution device. The handle extends outwardly from the surface of the distribution device. The method includes enclosing the handle with a cover to prevent the operator access to the handle while in the locked position; supporting the cover about the handle by abutting cover to the surface of the distribution device; reversibly locking the cover to the distribution device; and allowing the operating mechanism to move the handle from the locked position to a second position without interference from the cover wherein the handle positively indicates the state of the operating mechanism between the positions.

The enclosing step can also include enclosing the handle with the cover to prevent the operator access to the handle while in the second position. The allowing step can include moving the handle from the locked position to the second position with each position enclosed by the cover. Furthermore, the method can include the step of providing the handle to be viewed by the operator through the cover.

In another embodiment of the inventive method, the allowing step includes externally passing the handle through an opening in the cover as the handle moves from the locked position to the second position.

While particular embodiments and applications of the present applications of the present invention have been illustrated and described, it is to be understood that the invention is not limited to the precise construction disclosed herein and that various modifications, changes, and variations will be apparent to those skilled in the art may be made in the arrangement, operation, and details of construction of the invention disclosed herein without departing from the spirit and scope of the invention as defined in the appended claims.

What is claimed is:

1. A guard for preventing movement of a handle by an operator from a locked position to a second position, the handle being coupled to an operating mechanism which controls a distribution device, the handle extending outwardly from the surface of the distribution device, the guard comprising:

a cover configured to substantially enclose the handle while in the locked position, the cover being supported about the handle by abutting the surface of the distribution device, the cover also configured to allow the handle to move from the locked position to the second position wherein the cover prevents an operator, but not the operating mechanism, from moving the handle from the locked position to the second position and the handle positively indicates the state of the operating mechanism between the positions, the cover having an opening positioned perpendicular to the direction of movement of the handle, the opening configured to allow the handle to externally pass from enclosure by the cover as the handle moves from the locked position to the second position;

means for reversibly locking the cover to the distribution device, the locking means being integrally formed with the cover.

2. The guard of claim 1 wherein the cover further includes:

an elongated base having a perimeter, the base is elongated parallel to the direction of movement of the handle from the locked position to the second position;

a wall integrally formed with and extending substantially continuously about the perimeter of the base at one end of the wall, the wall upstanding generally perpendicular from the base, the opposite end of the wall configured to abut the surface of the distribution device; and the cover is made from a transparent material.

3. The guard of claim 1 wherein the cover further includes:

an base having a perimeter;

a wall integrally formed with and extending substantially continuously about the perimeter of the base at one end of the wall, the wall upstanding generally perpendicular from the base, the opposite end of the wall configured to abut the surface of the distribution device; and the opening positioned within the wall perpendicular to the direction of the movement of the handle.

4. The guard of claim 1 wherein the locking means includes a first element of a fastener formed with the cover and corresponding to a second element of the fastener coupled to the distribution device.

5. The guard of claim 1 wherein the locking means includes a hasp for receiving a fastener coupled to the distribution device.

6. The guard of claim 1 wherein the distribution device is an electrical circuit interrupter.

7. The guard of claim 1 wherein the cover includes a hinge at one end of the cover, the hinge configured to couple to the surface of the distribution device near the handle wherein the guard reversibly swings away from the surface of the distribution device on the hinge to provide the operator access to the handle in the locked position.

8. The guard of claim 1 wherein the cover includes a fastener integrally formed therewith at one end of the cover away from the locking means, the fastener is configured to mate with a corresponding fastener on the surface of the distribution device near the handle wherein the guard is reversibly removed from the surface of the distribution device to provide the operator access to the handle in the locked position.

9. A guard for preventing movement of a handle by an operator from an OPEN position to a CLOSED position, the handle being coupled to an operating mechanism which controls the electrical contacts of a circuit interrupter, the handle extending outwardly from a mating surface of the circuit interrupter, the guard comprising:

a cover configured to substantially enclose the handle while in the OPEN position, the cover having a complimentary shape for abutting the mating surface of the circuit interrupter for support of the cover near the handle, the cover also configured to allow the handle to move from the OPEN position to the CLOSED position wherein the cover prevents an operator, but not the operating mechanism, from moving the handle from the OPEN position to the CLOSED position and the handle positively indicates the state of the electrical contacts between the positions, the cover having an opening positioned in the cover perpendicular to the direction of movement of the handle, the opening configured to allow the handle to externally pass from enclosure by the cover as the handle moves from the OPEN position to the CLOSED position;

means for reversibly fastening the cover to the circuit interrupter.

10. The guard of claim 9 wherein the cover further includes:

an elongated base having a perimeter, the base is elongated parallel to the direction of movement of the handle from the OPEN position to the CLOSED position;

a wall integrally formed with and extending substantially continuously about the perimeter of the base at one end of the wall, the wall upstanding generally perpendicular from the base, the opposite end of the wall configured to abut the surface of the distribution device; and the cover is made from a transparent material.

11. The guard of claim 9 wherein the cover further includes:

an base having a perimeter;

a wall integrally formed with and extending substantially continuously about the perimeter of the base at one end of the wall, the wall upstanding generally perpendicular from the base, the opposite end of the wall configured to abut the surface of the distribution device; and the opening positioned within the wall perpendicular to the direction of the movement of the handle.

12. The guard of claim 9 wherein the fastening means includes a first element of a fastener formed with the cover and corresponding to a second element of the fastener coupled to the circuit interrupter.

13. The guard of claim 9 wherein the fastening means includes a hasp for receiving a fastener coupled to the circuit interrupter.

14. The guard of claim 9 wherein the cover includes a hinge at one end of the cover, the hinge configured to couple to the surface of the circuit interrupter near the handle wherein the guard reversibly swings away from the surface of the interrupter on the hinge to provide the operator access to the handle in the OPEN position.

15. The guard of claim 9 wherein the cover includes a fastener integrally formed therewith at one end of the cover away from the locking means, the fastener is configured to mate with a corresponding fastener on the surface of the circuit interrupter near the handle wherein the guard is reversibly removed from the surface of the interrupter to provide the operator access to the handle in the OPEN position.

16. A method of positively indicating the state of an operating mechanism controlling a distribution device while simultaneously preventing movement of a handle coupled to the operating mechanism by an operator from a locked position to a second position, the handle being coupled to an operating mechanism which controls a distribution device, the handle extending outwardly from the surface of the distribution device, the method comprising the steps of:

enclosing the handle with a cover to prevent the operator access to the handle while in the locked position;

supporting the cover about the handle by abutting cover to the surface of the distribution device;

reversibly locking the cover to the distribution device;

externally passing the handle through an opening in the cover as the handle moves from the locked position to the second position; and allowing the operating mechanism to move the handle from the locked position to a second position without interference from the cover wherein the handle positively indicates the state of the operating mechanism between the positions.

17. The method of claim 16 wherein:

the enclosing step includes enclosing the handle with the cover to prevent the operator access to the handle while in the second position;

the allowing step includes moving the handle from the locked position to the second position with each position enclosed by the cover; and the method further includes the step of providing the handle to be viewed by the operator through the cover.

* * * * *